US005904196A

United States Patent [19]

Wickers

[11] Patent Number: 5,904,196

[45] Date of Patent: May 18, 1999

[54] DECORATIVE COVER FOR UPRIGHT VACUUM CLEANER

[75] Inventor: Kendra L. Wickers, Naugatuck, Conn.

[73] Assignee: Liberty Star, Inc., Maplewood, N.J.

[21] Appl. No.: 08/835,178

[22] Filed: Apr. 7, 1997

[51] Int. Cl.[6] ..... B65D 65/02

[52] U.S. Cl. ..... 150/165; 150/154; 206/457

[58] Field of Search ..... 150/154, 155, 150/165; 206/457, 320; 446/72, 73; 15/247, 257.01

[56] References Cited

U.S. PATENT DOCUMENTS

| | | | |
|---|---|---|---|
| 1,340,863 | 5/1920 | Knight | 150/165 X |
| 2,704,903 | 3/1955 | Laughlin | 150/154 X |
| 3,771,192 | 11/1973 | Zaleski | 446/72 X |
| 4,607,674 | 8/1986 | Noble | 150/154 X |
| 5,040,679 | 8/1991 | Rehmann | 206/457 |
| 5,078,640 | 1/1992 | Berman | 446/72 |
| 5,375,928 | 12/1994 | Yarng et al. | 150/154 X |
| 5,487,467 | 1/1996 | Sherman | 206/457 X |

OTHER PUBLICATIONS

Country Patterns from Ozark Crafts Rebecca & Her Bunnies © 1989, Saint Nicholas © 1990, Tea Time Tilley © 1992, Granny Mae © 1993 .

Country Pattern from Ozark Crafts, "Sweet Suzanne" (see tunnel) 1987.

*Primary Examiner*—Sue A. Weaver

*Attorney, Agent, or Firm*—Robert L. Epstein, Esq.; Harold James, Esq.; James & Franklin, LLP

[57] ABSTRACT

The head portion of the cover is formed of a fabric wall which fully encloses the soft fill material. The wall defines an internal cylindrical recess with a closed top end and an open bottom. First and second arm-like appendages extend outwardly from opposite sides of the head portion. A substantially tubular fabric body portion attaches to the head portion and has openings adapted to receive the appendages. The visible part of the head portion is provided with animal or character facial elements. The body portion is appropriately decorated to coordinate with the head portion. The cover is received over the vacuum cleaner with the upstanding handle member of the vacuum cleaner extending into the recess in the head portion and the body surrounding the vacuum cleaner.

6 Claims, 5 Drawing Sheets

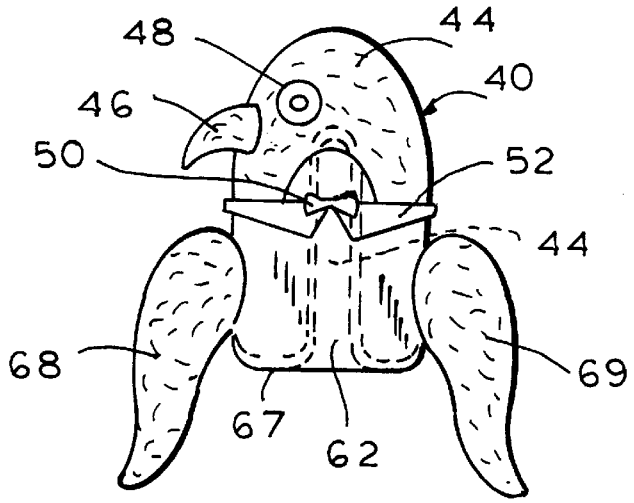
FIG. 4
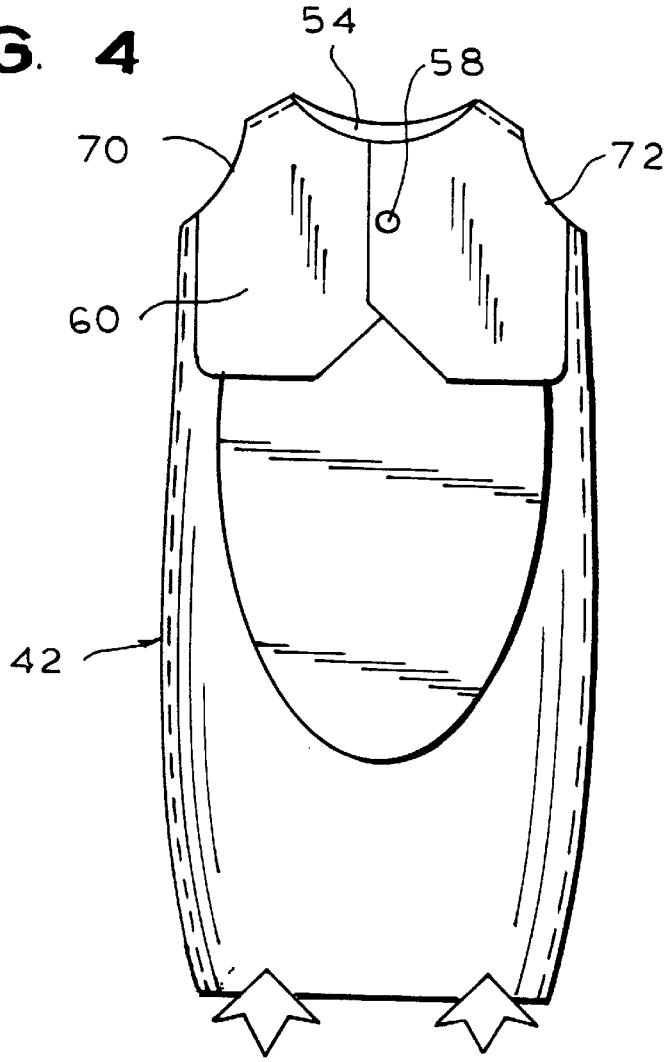

DECORATIVE COVER FOR UPRIGHT VACUUM CLEANER

The present invention relates to decorative fabric covers with simulated animal or character designs adapted for use with upright vacuum cleaners and more particularly to such a cover with a fully enclosed stuffed head portion defining an internal cylindrical recess which is received over the upstanding handle member of the vacuum and a body portion, attached to the head, which surround the vacuum.

BACKGROUND OF THE INVENTION

1. Field of the Invention

Upright vacuum cleaners are used in residential and commercial premises throughout this country and the world. When not in use, such vacuum cleaners are generally kept out of sight, as much as possible, because the appearance of such devices is not particularly asthetically pleasing. Covers for such vacuum cleaners are known which are adapted to be received over the upstanding handle member of the vacuum so as to obscure the device from view. These covers may be decorative in nature, often simulating the appearance of an animal or a human-like character. They also serve to keep dust and dirt from the vacuum cleaner when the device is in storage.

2. Description of Related Art

However, conventional covers designed for this purpose tend to be constructed poorly, utilizing inferior materials and assembly techniques. In one known cover, the head portion is simply an open mouth fabric bag stuffed with soft fill material. The open mouth of the bag is affixed to a piece of cardboard. The cardboard has a large central opening. Accordingly, the fill material is not fully enclosed and can come out the head portion when the cover is removed from the vacuum. All of the parts of the cover are sewn together or held together by elastic in a very inferior manner.

It is, therefore, a prime object of the present invention to provide a cover for an upright vacuum cleaner which utilizes superior construction techniques.

It is another object of the present invention to provide a cover for an upright vacuum cleaner in which the fill material is fully enclosed a fabric wall which defines a recess adapted to receive the handle member of the vacuum.

BRIEF SUMMARY OF THE INVENTION

In accordance with one aspect of the present invention, a cover for an upright vacuum cleaner of the type having an upstanding handle member is provided. The cover comprises a head portion formed of a fabric wall which fully encloses a wad of soft fill material. The head portion has an elongated internal recess, defined by the fabric wall. A substantially tubular fabric body is affixed to and extends from the head portion. The cover is adapted to be received on the vacuum cleaner with the upstanding handle member extending into the internal recess of the head portion and the body portion surrounding the vacuum cleaner.

First and second appendages extend from the head portion. The body portion has openings adapted to receive the appendages.

The fabric wall of the head portion is provided with simulated animal or character facial features. The body portion is provided with decorations which visually coordinate with the facial features of the head portion.

The recess has an open bottom end and a closed top end. The open bottom end is defined by the section of the fabric wall where the interior portion of the wall and the exterior portion of the fabric wall join together.

BRIEF DESCRIPTION OF THE SERVERAL VIEWS OF THE DRAWINGS

To these and to such other objects which may hereinafter appear, the present invention relates to a decorative cover for an upright vacuum cleaner, as set forth in detail in the following specification, recited in the annexed claims and illustrated in the accompanying drawings, wherein like numerals relate to like part and in which:

FIG. 4 is an exploded front elevantional view of the preferred embodiment of the invention illustrated in FIG. 3;

DETAILED DESCRIPTION OF THE INVENTION

Figure 1:
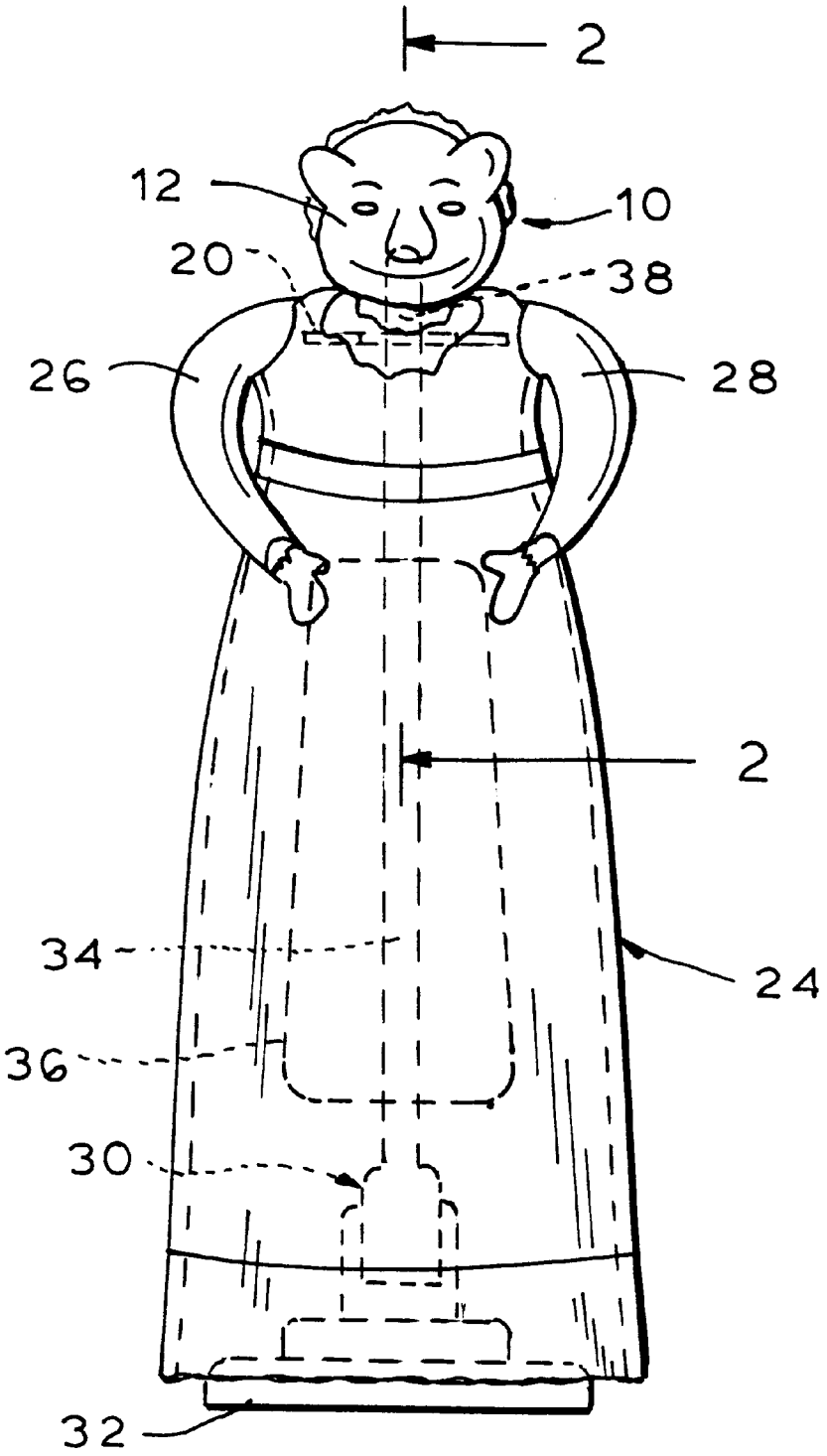
FIG. 1 PRIOR ART
FIG. 1 is a front elevational view of a conventional cover situated on an upright vacuum cleaner.
Figure 2:
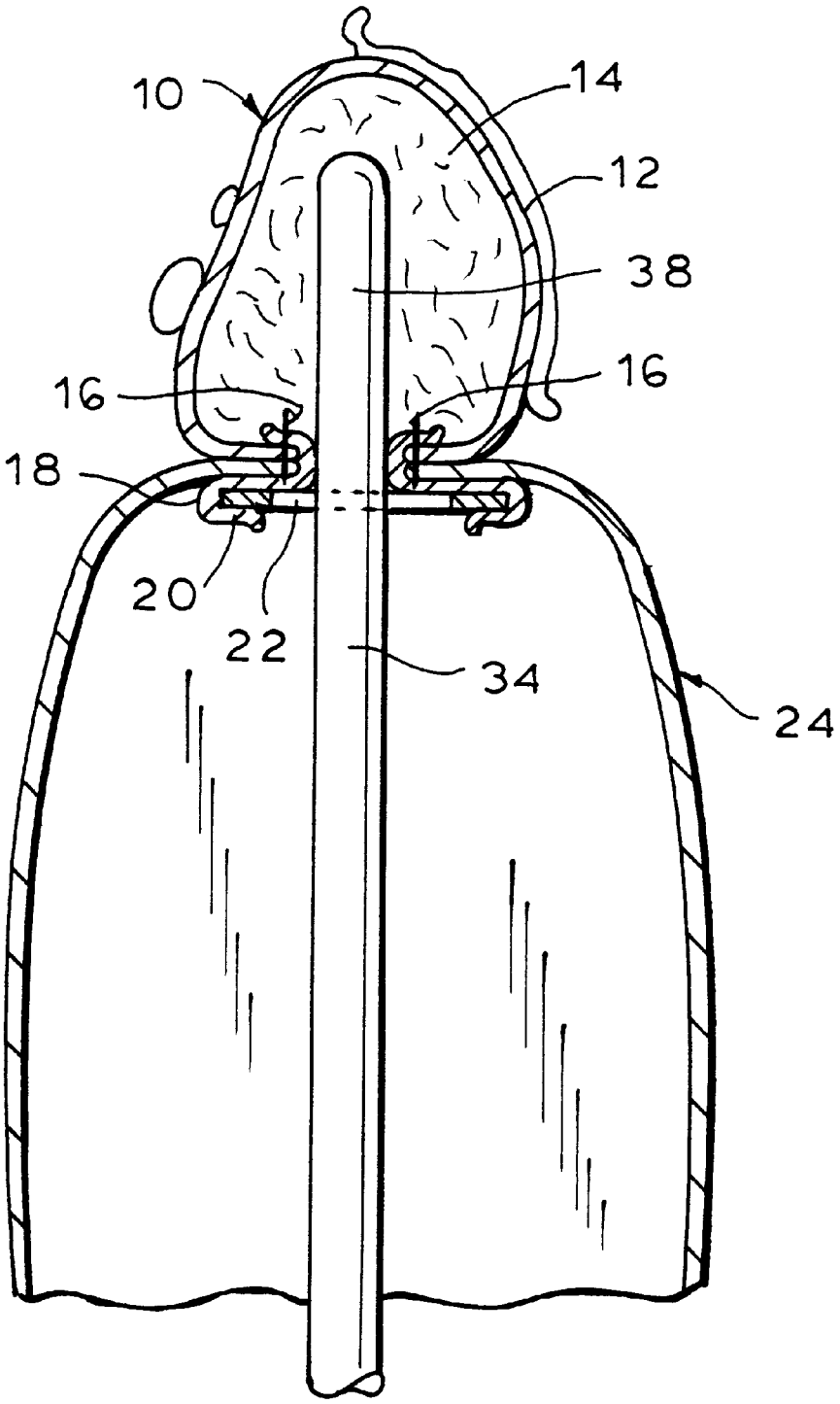
FIG. 2 PRIOR ART
FIG. 2 is a side cross-sectional view of the upper portion of the conventional cover of FIG. 1.

FIGS. 1 and 2 show a conventional cover. This cover includes a head 10 formed of an open mouth fabric bag 12. Bag 12 is filled with soft cotton-like polyester or similar fill material 14.

Attached to the mouth of bag 12, by stitches 16, is an elastic fabric element 18. Element 18 stretches over and holds a cardboard collar 20. Collar 20 has a central opening 22.

The body 24 of the conventional cover is permanently affixed to head 10 by a stitches 16. Arms 26, 28 are fabric tubes, enclosing fill material, which are sewn directly to body 24.

The cover of FIG. 1 is received over an upright vacuum cleaner, generally designated 30. Vacuum cleaner 30 includes a base 32 and an upstanding handle member 34 to which a collection bag 36 is attached. The top of member 34 is handle grip part 38.

As seen in FIG. 2, handle grip part 38 extends through the opening 22 in collar 20 and into the wad of fill material 14 within bag 12 when the cover is received over the vacuum. However, with this conventional structure, fill material 14 is not fully enclosed and may come out of bag 12 through opening 22 when the cover is removed from the vacuum cleaner. Moreover, collar 20 may accidently separate from fabric element 18 because it is held only by the elasticity of the fabric element.

The present invention utilizes an improved structure. The cardboard collar and elastic fabric element are eliminated completely. The fill material is completely enclosed in the head portion. Moreover, the cover is formed of two detachable portions.

The preferred embodiment of the cover of the present invention is decorated as a penguin. Hence, the visible part of the head may be formed of black fur-like fabric and have a beak, an eye, a white collar and bow tie. The body may be black, have a vest, a white belly and feet. It should be understood that this particular decoration plays no part in the present invention and should not be considered to be a limitation on the present invention. It is shown for illustrative purposes only.

Figure 3:
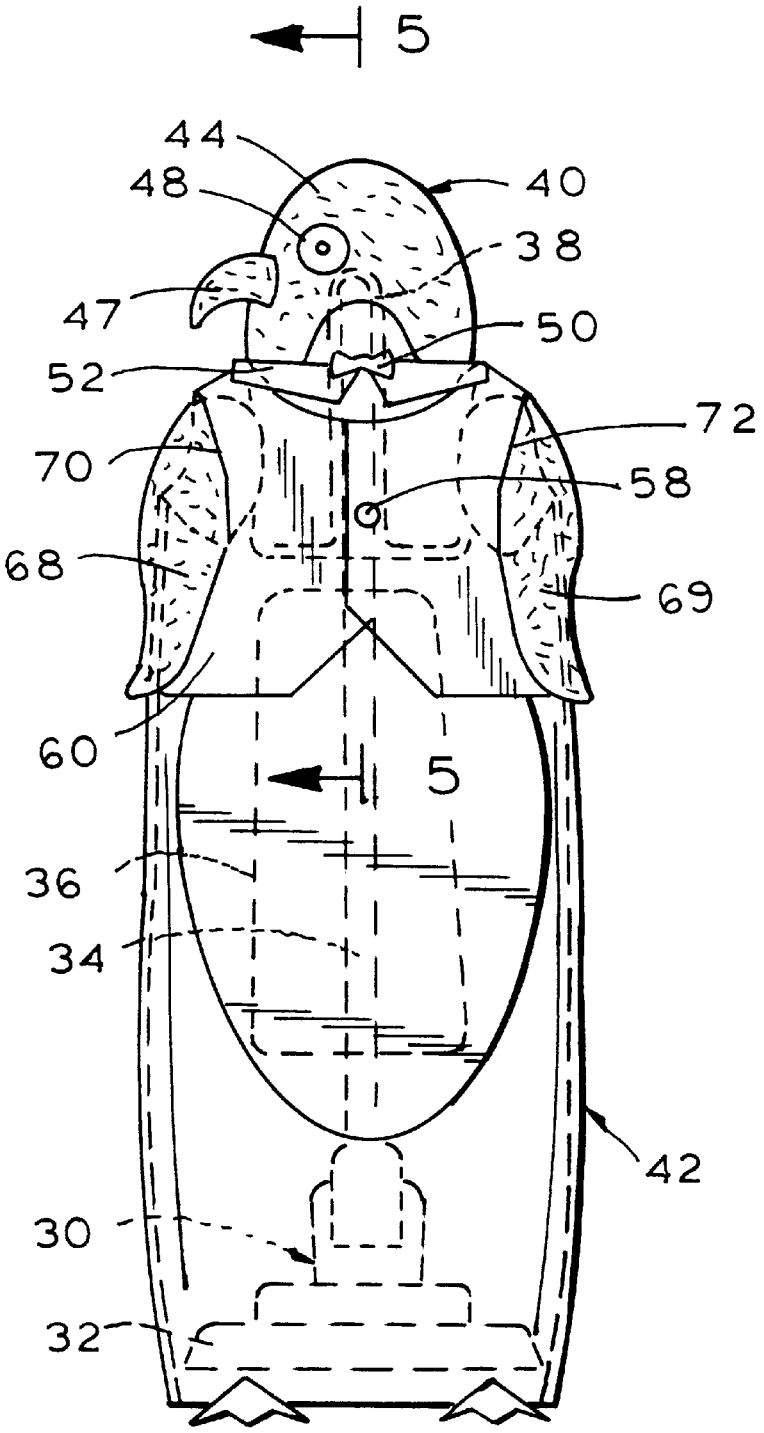
FIG. 3 is a front elevational view of a preferred embodiment of the present invention situated on an upright vacuum cleaner.
Figure 5:
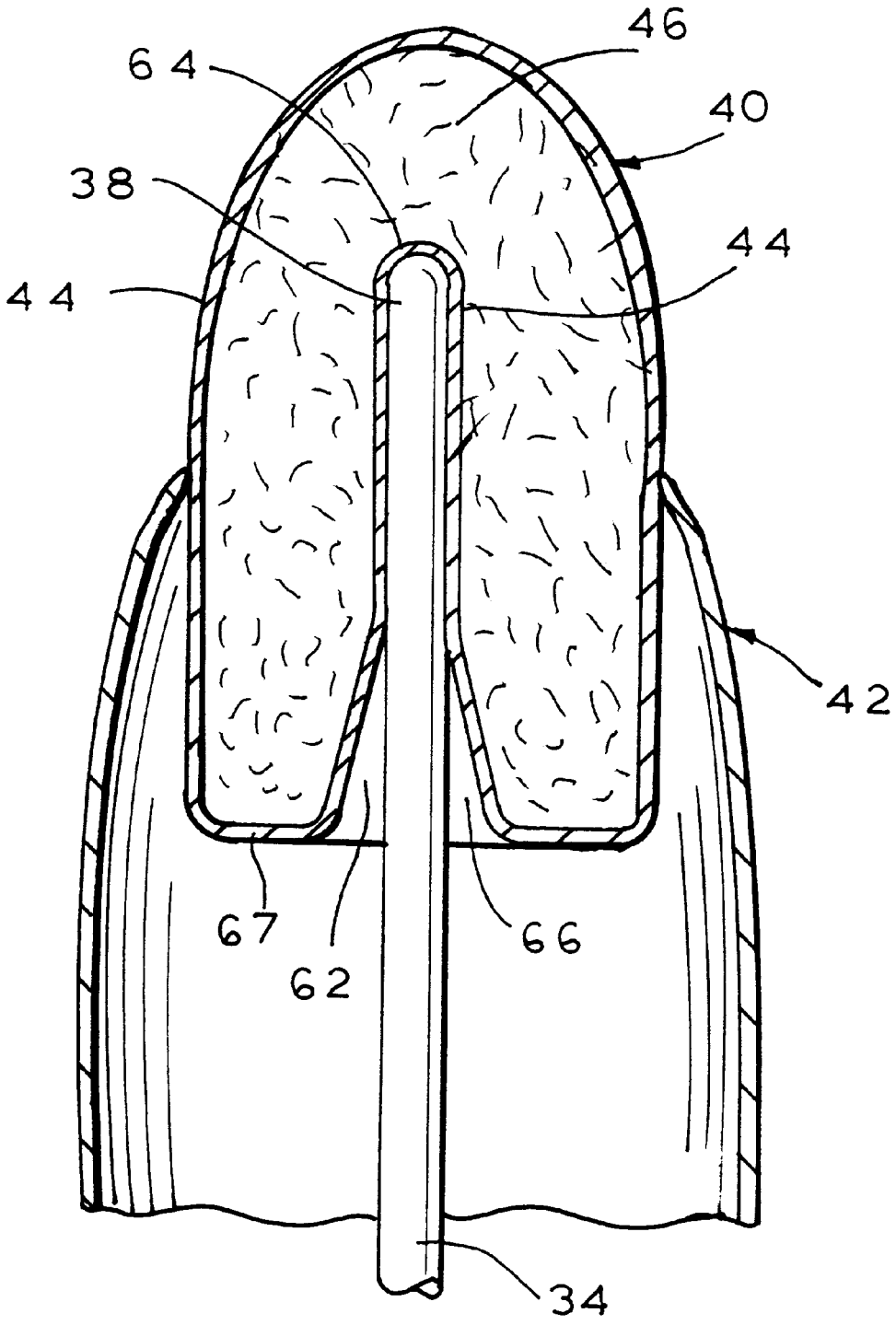
FIG. 5 is a side cross-sectional view of the upper portion of the preferred embodiment of the present invention illustrated in FIG. 3.

As shown in FIGS. 3–5, the cover of the present invention is formed of two parts, a head portion, generally designed 40, and a tubular body portion, generally designated 42. Head portion 40 is formed of a fabric wall 44 which completely encloses a wad of soft fill material 46. In this case because of the penguin design, the visible portion of fabric wall 44 of the head portion is made of fur-like material and is provided with simulated facial features, such as nose (in this case a beak) 47, and an eye 48, which are affixed thereto by stitching or the like. Other features, such as a bow tie 50 and collar 52 may be used as well to further enhance the asthetic appeal of the cover.

The body portion 42 is removeably attached to the head portion 40 by friction fit. Body portion 44 is a substantially tubular fabric member with a top opening 54. It may be affixed to head portion 40 by the rim of opening 54 closing around the head portion in the manner of a conventional dress, that is, an open slit in the back of the fabric is closed by a snap, velcro or any other conventional fastening means tightly around the head portion. Body portion 42 is skirt-like and has on the exterior features such as a button 58 and vest 60 which coordinate in appearance with the simulated facial features of the head.

Head portion 44 has an elongated internal recess 62 which extends along its vertical axis and is defined by a substantially cylindrical internal section of the fabric wall 44. Recess 62 has a closed top end 64 and an open bottom end 66. Open bottom end 66 is defined by section 67 of the fabric wall where the interior portion of the wall and the exterior portion of the wall join.

The handle grip part 38 of the upstanding handle member 34 of the vacuum is received in recess 62 of head portion 40 as the cover is mounted on the vacuum cleaner. The top of the handle grip part 38 abuts the top closed end 64 of the recess 62. Body portion 42 extends downwardly from the head portion and surrounds the vacuum cleaner.

Extending from opposite sides of the head portion 40 are a pair of stuffed tube-like appendages 68, 69 which may simulate arms (or in this case wings). Body portion 42 is provided with openings 70, 72 which receive the appendages 68, 69 respectively, when the body portion is mounted on the head portion. Body portion 42 may be provided with sleeve-like elements to cover appendages 68, 69, if desired. However, in this case, no sleeve-like elements are present.

It should now be appreciated that the present invention relates to a two part decorative cover for an upright vacuum cleaner which utilizes superior construction and in which the soft fill material of the head portion is fully enclosed in a fabric wall which also forms the handle receiving recess. The body portion consists of a skirt-like portion with openings to receive appendages from the head portion.

While only a single preferred embodiment of the present invention has been disclosed for purposes of illustration, it is obvious that many modifications and variations could be made thereto. It is intended to cover all of these variations and modifications which fall within the scope of the present invention, as defined by the following claims:

I claim:

1. A cover for an upright vacuum cleaner of the type having an upstanding handle member, the cover comprising a head portion and a body portion, said head portion comprising soft fill material and a fabric wall completely enclosing said soft fill material, said fabric wall defining an elongated internal recess in said head portion, said recess having an enlarged open bottom end, a closed top end and an intermediate portion of substantially uniform diameter, said body portion being formed of a substantially tubular fabric member and being attached to said head portion, said cover being adapted to be received on the vacuum cleaner with the handle member extending into said internal recess and said body portion surrounding the vacuum cleaner.

2. The cover of claim 1 further comprising first and second appendages extending from said head portion.

3. The cover of claim 2 wherein said body member further comprises first and second openings adapted to receive said first and second appendages, respectively.

4. The cover of claim 1 wherein said fabric wall of said head portion is provided with simulated facial elements.

5. The cover of claim 4 wherein said body portion is provided with elements coordinated with said facial elements.

6. The cover of claim 1 wherein said fabric wall comprises an exterior portion and an interior portion and wherein said open bottom end is defined by the section of said fabric wall where said interior portion and said exterior portion join.

* * * * *